United States Patent [19]

Love

[11] 4,452,605

[45] Jun. 5, 1984

[54] CONTINUOUS YARN DYEING: UNIFORMLY COATING RUNNING YARN WITH DYE LIQUID, DRYING AND FIXING WITH HEAT

[75] Inventor: Ronald B. Love, Paisley, Scotland

[73] Assignee: J & P Coats, Limited, Glasgow, Scotland

[21] Appl. No.: 438,944

[22] Filed: Nov. 3, 1982

[30] Foreign Application Priority Data

Nov. 7, 1981 [GB] United Kingdom ..... 8133659

[51] Int. Cl.[3] ..... D06B 1/12; D06B 17/04

[52] U.S. Cl. ..... 8/494; 8/155; 8/495; 8/922

[58] Field of Search ..... 8/494, 495, 155

[56] References Cited

U.S. PATENT DOCUMENTS 3,751,778 8/1973 Grosjean et al. ..... 8/494
3,893,806 7/1975 Finch et al. ..... 8/494
3,973,908 8/1976 Dunn ..... 8/494

FOREIGN PATENT DOCUMENTS 2911381 8/1980 Fed. Rep. of Germany .
861035 2/1961 United Kingdom .
1253657 11/1971 United Kingdom .
2037188 7/1980 United Kingdom .

*Primary Examiner*—A. Lionel Clingman
*Attorney, Agent, or Firm*—Larson and Taylor

[57] ABSTRACT

A process for continuously dyeing yarn comprises coating the surface of a continuously moving yarn with a uniform coating of dye liquid deposited at a rate such that the amount of dye liquid deposited per unit area of yarn surface is less than the same unit area of the yarn could absorb naturally then heating the coated yarn so as first to remove substantially all the liquid from the dye and then to cause the dye to penetrate and become fixed in the yarn.

8 Claims, 1 Drawing Figure

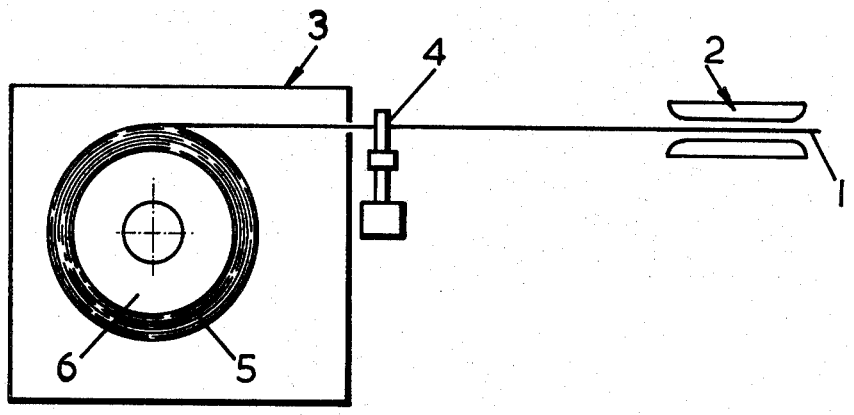
3
4
2
1
6
5

CONTINUOUS YARN DYEING: UNIFORMLY COATING RUNNING YARN WITH DYE LIQUID, DRYING AND FIXING WITH HEAT

The subject of this invention is a process and apparatus for the continuous dyeing of yarns.

Various processes are known for the continuous dyeing of fabrics as opposed to yarns all of which processes are aimed at providing an even dye take up with the minimum of operational steps. No commercially acceptable process for the continuous dyeing of yarn providing an even dye take up along the length of the yarn has so far been proposed.

Known processes for the continuous dyeing of fabric all basically include the steps of passing the fabric continuously through a dyebath containing a conventional water soluble or dispersable dye diluted with water and usually with other additions, then squeezing the fabric to assist dye impregnation and to express as much liquid as can be expelled mechanically, drying the fabric and fixing the dye by a non-contact process such as infra-red heating, washing the continuously moving fabric to remove dye not taken up by the fabric and any other materials such as thickener added to the dyebath, then yet again drying the fabric. The liquid expelled by squeezing the fabric and the washing water are usually treated in an effluent treatment plant since such liquid cannot simply be discharged to waste.

All the customary commercial processes of dyeing yarn require that the yarn should be washed subsequent to the dyeing operation. This is to remove loose particules of dye which have not penetrated the fibres of the yarn. Previously known processes for the dyeing of fabrics and yarns require complicated and large apparatus for the dyeing and subsequent washing steps including the large ancillary plants required for steam generation and to deal with the effluent from the washing step. Thus a most desirable advance in dyeing technology would be a method of dyeing a yarn continuously at a commercially acceptable speed which provides sufficient evenness of dye take up along the length of the yarn, which does not require steam generation and any washing step after the original dyeing operation and does not produce any liquid effluent requiring treatment.

It is an object of the present invention to provide a process and apparatus for dyeing yarn which fulfils the above mentioned requirements.

According to the invention a process for continuously dyeing yarn by the application of dye in liquid form to a continuously moving yarn is characterized in that the dye liquid is deposited on the yarn surface in the form of a uniform coating at a rate such that the amount of dye liquid applied per unit of surface area of the yarn fibres is less than the minimum natural sorptive ability of the same unit of surface area of the yarn fibres to take up dye, then the dye-coated yarn is subjected to a heating operation arranged first to cause any liquid present in the dye coating to be substantially removed then to cause the dye to penetrate and become fixed in the yarn.

The dye in liquid form may be a highly concentrated solution or a dispersion or a suspension of dye particles in a carrier liquid.

The expression "sorptive ability of the yarn fibres" means the maximum weight of dye liquid which can be naturally taken up by a given area of surface of the particular yarn fibres.

The dye liquid may be present in a proportion lying in the range 0.15–0.70 parts of liquid W/W, usually water, to 1.00 part W/W of the yarn material. The proportion of dye to yarn depends on several factors principally the particular dye used, the structure of the yarn and the shade required.

The dye may be applied to the yarn by passing the yarn between pads of porous material fed with the dye liquid at a controlled rate e.g. by a metering pump such that the dye liquid is deposited on the surface of the yarn in the required amount per unit area of the yarn surface. Alternatively, the pressure the pads exert on the yarn may be varied.

The heating operation may be performed in separate stages, in one of which substantially all liquid is removed from the dye and in another of which penetration into the yarn and fixing of the dye in the yarn fibres occurs. The heating stages may be conducted at different temperatures. The dye liquid may contain a quantity of material which will assist levelling and penetration of the dye e.g. a glycol.

The process of the present invention is applicable to yarns formed either from synthetic or natural fibres. The yarn after application of the dye may be led through an atmosphere of hot dry gas to a hot bobbin on which it is wound, continuous winding on the bobbin being performed so that the yarn is laid in successive layers one on top of the other, the dye on the yarn forming each layer being dried while it is passing through the atmosphere of hot dry gas and being fixed during formation of that layer by the heat absorbed from the previous layer on which it is lying. Thus each layer contains finished dyed yarn before the next layer is laid on top of it. In performance of this process the heating conditions may be such that the yarn remains at a lower temperature until the liquid phase has been eliminated and as soon as the yarn has dried the temperature of the yarn then rises so that fixing of the dye occurs, the rise of temperature occurring because of the stoppage of absorption of latent heat in the liquid phase of the dye. Thus each bobbin of yarn may be removed in a completely dyed and stable form as soon as the bobbin has been filled to the desired extent. The entire dyeing, penetration and fixation processes are completed during the time the yarn is on the bobbin. Also because the yarn of each layer is substantially dry before the next layer is obscured by subsequent layers the action is rapid and speeds exceeding 2000 m/minute are readily achieved. Such a speed approaches an order of magnitude greater than anything which has so far been commercially attained in the dyeing of yarn.

Apparatus for performing the process may comprise a closed chamber formed with an entry for yarn, a driven bobbin in the chamber, means for maintaining the chamber full of dry hot gas, means for guiding yarn in side by side convolutions on to the bobbin and means for depositing dye liquid on the surface of a yarn on its way to the yarn guide means in a predetermined quantity per unit area of yarn surface.

One embodiment of the invention which has been successfully performed in practice is illustrated in the accompanying diagrammatic drawing. The process is capable of dyeing a very wide variety of different yarns made by any of many processes of yarn formation and of providing finished spools of dyed yarn.

In the drawing a yarn 1 to be dyed passes continuously through a dye applicator 2 which is arranged to deposit dye liquid in the form of a substantially uniform coating of dye on the exposed surface of the fibres of the yarn 1, the applicator being arranged, e.g. by controlling the amount of dye liquid fed to it, to control the amount of dye liquid deposited on the dye surface so that the amount deposited per unit of surface area of the yarn fibres is less than the minimum sorptive ability of the same unit surface area of the yarn fibres to take up dye. The dye-coated yarn then enters a chamber 3 in which there is maintained an atmosphere of dry hot gas in which substantially all the liquid is removed from the dye by evaporation. The yarn is then guided by a traversing device 4 to form layers 5 on a bobbin 6. The dye in the dried yarn fed on to the bobbin 6 is fixed by the ambient heat as the yarn is wound on to the bobbin and the yarn in each layer is substantially dry before the next layer is laid on the bobbin. When the bobbin contains a predetermined quantity of yarn it may be removed and a fresh empty bobbin fitted.

The process of the invention provides the important advantages of high throughput speed, low cost of operation and of plant, smaller space taken up by the apparatus, small labour requirements and no necessity for washing the yarn or purifying and disposing of effluent. The high speed is attained largely because of the presence of a very low proportion of liquid phase which the process of the invention makes possible. This will be evident when it is remarked that in conventional dyeing techniques there are usually at least 90 parts of water used to each part of yarn necessitating not only a large consumption of energy but also the considerable time required for that large quantity of water to be removed. The large cost saving results from the small quantity of liquid to be removed necessitating only a small consumption of energy and the low cost of plant is because the only apparatus required is the apparatus to coat the yarn fibres with dye and to dry and fix the dye. No washing equipment is required and no effluent treatment plant is required. The small space required results from the small amount of apparatus e.g. only apparatus to apply the dye and apparatus to dry the yarn and the small labour requirement results from the fact that the process is continuous and requires little supervision. Once conditions of speed and temperature are set the only requirements is that these parameters should be monitored to make sure that they are maintained. Even here the system may be made automatic so that changes in speed and gas temperature are noted by the apparatus and atuomatic compensation made for such changes.

In addition to the operating advantages described above the process provides a very important commercial advantage in that small lots of yarn, for example lots as small as 1 kg required in particular shades of colour can be dyed readily and at an economic cost. This is because only a few readily cleaned or readily changed parts of the apparatus come into contact with the yarn after the dye has been applied. In known processes the large vats used to hold the dye and the washing apparatus usually require to be thoroughly cleaned when a change of colour is required. Also the initial formation of a controlled coating of dye as described on the surface of the yarn provides for very accurate metering of the quantity of dye on each unit length of the yarn and all that dye is absorbed by the yarn for the reason described. The dye take up characteristics of the yarn in the method of the invention have little or no effect on the shade produced because of the manner in which the dye is applied to the yarn i.e. in a form containing the minimum amount of liquid component and as a coating which is applied in a manner akin to painting so that control of the quantity of dye applied to a unit length of the yarn is exercised by the applicator and not by the dye take up characteristics of the yarn as is the case in known dyeing techniques.

It is quite easy to measure that the amount of dye liquid applied per unit of surface area of the yarn fibres is less than the minimum natural sorptive ability of the same unit of surface area of the yarn fibres to take up dye. There are several ways of detemining this. One way is to weigh a predtermined length of yarn in the dry state, soak it in dye liquid and weigh it again, this giving the sorptive ability of that length of yarn, then adjusting the dye applying device so that the same length of dyed yarn weighs less than the length of yarn completely soaked with the dye.

An example of performance of the process is given below.

EXAMPLE

A three ply spun polyester yarn of 85 d'tex with a previously determined sorptive capability of 200% its own weight of dye liquid was fed through the dye applying pads at a speed of 1000 m/minute while dye liquid in a concentration of 10g of concentrated disperse dyestuff per litre of water was deposited on the yarn at a rate of 12 ml/minute which gives a weight of dye liquid equal to 45% of the weight of yarn. The yarn was wound still at a speed of 1000 m/minute and in side by side convolutions on to a bobbin enclosed in a chamber containing dry air at a temperature of 120° C. in which substantially all liquid was removed from the dye. Immediately after winding the bobbin containing the dyed yarn was held at a temperature of 180° C. for 90 minutes during which the dye was fixed after which the yarn was ready for use without any subsequent treatment and without the production of any effluent to be treated or dispoed of.

I claim:

1. A process for continuously dyeing yarn which comprises continuously coating a moving yarn with a uniform coating of dye liquid deposited on the surface of the yarn at a rate such that the amount of dye liquid applied per unit of surface area of the yarn fibres is less than the minimum natural sorptive ability of the same unit of surface area of the yarn fibres to take up dye, and heating the coated yarn first to cause any liquid present in the dye coating on the surface of the yarn to be substantially removed then to cause the dye to penetrate below the surface of the yarn and become fixed in the yarn.

2. A process for continuously dyeing yarn as claimed in claim 1 in which the dye liquid is present in a proportion lying in the range 0.15–0.70 parts of liquid W/W to 1.00 part W/W of the yarn material.

3. A process for continuously dyeing yarn as claimed in claim 1 in which the yarn passes between pads of porous material fed with the dye at a controlled rate such that the dye liquid is deposited on the yarn surface in the required amount per unit area of the yarn surface.

4. A process for continuously dyeing yarn as claimed in claim 1 in which the heating operation is performed in separate stages, in one of which substantially all liquid is removed from the dye and in another of which penetration into the yarn and fixing of the dye in the yarn fibres occurs.

5. A process for continuously dyeing yarn as claimed in claim 4 in which the heating stages are conducted at different temperatures.

6. A process for continuously dyeing yarn as claimed in claim 1 in which the dye liquid contains a quantity of material which assists levelling and penetration of the dye.

7. A process for continuously dyeing yarn . as claimed in claim 1 in which the yarn is led through an atmosphere of hot dry gas to a hot bobbin on which it is continuously wound, the continuous winding on the bobbin being performed so that the yarn is laid in successive layers one on top of the other, the dye on the yarn forming each layer being dried while it is passing through the atmosphere of hot dry gas and being fixed during formation of that layer by the heat absorbed from the previous layer on which it is lying.

8. A process for continuously dyeing yarn as claimed in claim 1 in which heating conditions are such that the yarn remains at a lower temperature until the liquid phase has been eliminated and as soon as the yarn has dried the temperature of the yarn then rises so that fixing of the dye occurs, the rise of temperature occurring because of the stoppage of absorption of latent heat in the liquid phase of the dye.

* * * * *